US005960724A

United States Patent [19]

Toqan et al.

[11] Patent Number: 5,960,724

[45] Date of Patent: Oct. 5, 1999

[54] METHOD FOR EFFECTING CONTROL OVER A RADIALLY STRATIFIED FLAME CORE BURNER

[76] Inventors: Majed A. Toqan, 8 Riverview, Avon, Conn. 06001; Richard W. Borio, 49 Deerfield Rd., Somers, Conn. 06071; Thomas G. Duby, 2348 Bigelow Commons, Enfield, Conn. 06082; Richard C. LaFlesh, 1668 Hill St., Suffield, Conn. 06078; Julie A. Nicholson, 69 Norwell St., West Haven, Conn. 06516; David E. Thornock, 190 Upper Valley Rd., Torrington, Conn. 06790

[21] Appl. No.: 09/123,055

[22] Filed: Jul. 27, 1998

Related U.S. Application Data

[63] Continuation of application No. 08/666,110, Jun. 19, 1996, abandoned.

[51] Int. Cl.[6] ..... F23C 1/10

[52] U.S. Cl. ..... 110/347; 110/260; 110/262; 431/181; 431/182; 431/183; 431/186; 431/187

[58] Field of Search ..... 110/260–262, 347; 431/181–183, 186, 187

[56] References Cited

U.S. PATENT DOCUMENTS 5,743,723 4/1998 Iatrides et al. ..... 431/183 X
5,829,369 11/1998 Sivy et al. ..... 110/347

*Primary Examiner*—Henry Bennett
*Assistant Examiner*—Marc Norman
*Attorney, Agent, or Firm*—Arthur E. Fournier, Jr.

[57] ABSTRACT

A method for effecting control over a radially stratified flame core burner that is particularly suited for employment in a firing system of a fossil fuel-fired furnace for purposes of reducing the $NO_X$ emissions from the fossil fuel-fired furnace. The subject method for effecting control over a radially stratified flame core burner enables the foregoing to be accomplished while yet at the same time minimizing CO emissions and the opacity of the exhaust from the stack of the fossil fuel-fired furnace without extending the envelope of the flame produced by the radially stratified flame core burner.

10 Claims, 5 Drawing Sheets

METHOD FOR EFFECTING CONTROL OVER A RADIALLY STRATIFIED FLAME CORE BURNER

This is a Continuation, of application Ser. No. 08/666,110, Filed Jun. 19, 1996.

BACKGROUND OF THE INVENTION

This invention relates to radially stratified flame core burners, which are employed in the firing systems of fossil fuel-fired furnaces, and more specifically, to a method for effecting control over a radially stratified flame core burner.

Fossil fuels have been successfully burned in furnaces for a long time. Recently though, more and more emphasis has been placed on the minimization as much as possible of air pollution. In this connection, with reference in particular to the matter of $NO_X$ control it is known that during the combustion of fossil fuels in furnaces oxides of nitrogen are created. Moreover, it is also known that these oxides of nitrogen are created primarily by two separate mechanisms, which have been identified to be thermal $NO_X$ and fuel $NO_X$.

Continuing, thermal $NO_X$ results from the thermal fixation of molecular nitrogen and oxygen in the air that is employed in the course of effecting the combustion of the fossil fuel. The rate of formation of thermal $NO_X$ is extremely sensitive to local flame temperature and somewhat less so to local concentration of oxygen. Virtually all thermal $NO_X$ is formed in the region of the flame that is at the highest temperature. The thermal $NO_X$ concentration is subsequently "frozen" at the level prevailing in the high temperature region by the thermal quenching of the combustion gases. The flue gas thermal $NO_X$ concentrations are, therefore, between the equilibrium level characteristic of the peak flame temperature and the equilibrium level at the flue gas temperature.

On the other hand, fuel $NO_X$ derives from the oxidation of organically bound nitrogen in certain fossil fuels such as coal and heavy oil. The formation rate of fuel $NO_X$ is strongly affected by the rate of mixing of the fossil fuel and air stream in general, and by the local oxygen concentration in particular. However, the flue gas $NO_X$ concentration due to fuel nitrogen is typically only a fraction, e.g., 20 to 60 percent, of the level which would result from complete oxidation of all nitrogen in the fossil fuel. Thus, it should now be readily apparent from the preceding that overall $NO_X$ formation is a function both of local oxygen levels and of peak flame temperatures.

Over the years, there have been different approaches pursued in the prior art insofar as concerns addressing the need to limit emissions of the $NO_X$ that is created as a consequence of the combustion of fossil fuels in furnaces. The focus of one such approach has been on developing so-called low $NO_X$ firing systems suitable for employment in fossil fuel-fired furnaces. By way of exemplification and not limitation in this regard, one example of such a low $NO_X$ firing system is that which forms the subject matter of U.S. Pat. No. 5,020,454 entitled "Clustered Concentric Tangential Firing System," which issued on Jun. 4, 1991 and which is assigned to the same assignee as the present patent application. In accordance with the teachings of U.S. Pat. No. 5,020,454, a clustered concentric tangential firing system is provided that includes a windbox, a first cluster of fuel nozzles mounted in the windbox and operative for injecting clustered fuel into the furnace so as to create a first fuel-rich zone therewithin, a second cluster of fuel nozzles mounted in the windbox and operative for injecting clustered fuel into the furnace so as to create a second fuel-rich zone therewithin, an offset air nozzle mounted in the windbox and operative for injecting offset air into the furnace such that the offset air is directed away from the clustered fuel injected into the furnace and towards the walls of the furnace, a close coupled overfire air nozzle mounted in the windbox and operative for injecting close coupled overfire air into the furnace, and a separated overfire air nozzle mounted in the windbox and operative for injecting separated overfire air into the furnace.

Another example of such a low $NO_X$ firing system is that which forms the subject matter of U.S. Pat. No. 5,315,939 entitled "Integrated Low $NO_X$ Tangential Firing System," which issued on May 31, 1994 and which is assigned to the same assignee as the present patent application. In accordance with the teachings of U.S. Pat. No. 5,315,939, an integrated low $NO_X$ tangential firing system is provided that includes pulverized solid fuel supply means, flame attachment pulverized solid fuel nozzle tips, concentric firing nozzles, close-coupled overfire air, and multi-staged separate overfire air and when employed with a pulverized solid fuel-fired furnace is capable of limiting $NO_X$ emissions therefrom to less than 0.15 lb./106 BTU while yet maintaining carbon-in-flyash to less than 5% and CO emissions to less than 50 ppm.

Yet another example of such a low $NO_X$ firing system is that which forms the subject matter of U.S. Pat. No. 5,343,820 entitled "Advance Overfire Air System for $NO_X$ Control," which issued on Sep. 6, 1994 and which is assigned to the same assignee as the present patent application. In accordance with the teachings of U.S. Pat. No. 5,343,820, an advanced overfire air system for $NO_X$ control is provided that includes multi-elevations of overfire air compartments to which overfire air is supplied such that there is a predetermined most favorable distribution of overfire air therebetween, such that the overfire air exiting from the separated overfire air compartments establishes a horizontal "spray" or "fan" distribution of overfire air exiting from the separated overfire air compartments at velocities significantly higher than the velocities employed heretofore.

The focus of another approach, which has been pursued in the prior art to address the need to limit emissions of the $NO_X$ that is created as a consequence of the combustion of fossil fuels in furnaces, has been on developing so-called low $NO_X$ burners that are suitable for integration into the firing systems that are employed in fossil fuel-fired furnaces. By way of exemplification and not limitation in this regard, one example of such a low $NO_X$ burner is that which forms the subject matter of U.S. Pat. No. 4,422,931 entitled "Method Of Combustion Of Pulverized Coal By Pulverized Coal Burner," which issued on Dec. 27, 1983 and which on its face is assigned to Kawasaki Jukogyo Kabushiki Kaisha of Kobe, Japan. In accordance with the teachings of U.S. Pat. No. 4,422,931, a low $NO_X$ burner is provided wherein pulverized coal is supplied together with primary air through a combustion air outlet of the low $NO_X$ burner and caused by a swirler to be injected into the furnace while flowing slowly in vortical form. Secondary air is injected into the furnace with exhaust gas through an inner annular outlet surrounding the combustion air outlet, the secondary air either flowing slowly in vortical form or not flowing in vortical form as the case may be. Tertiary air is injected into the furnace with exhaust gas through an outer annular outlet surrounding the inner annular outlet while flowing in vortical form. Pulverized coal supplied to the furnace together with primary air is combusted to form a primary flame. The primary flame is formed by slow combustion of the pulverized coal at low temperature with low $O_2$ and is low in brightness, because the primary air is about 20–30% in amount of the air necessary for combusting all the pulverized coal supplied therewith to the furnace and mixing of secondary and tertiary air therewith is prohibited. Combustion of a volatile component of the pulverized coal is mainly responsible for formation of the primary flame, so that the pulverized coal is combusted slowly at low temperature with a flame of low brightness. In this type of combustion, production of $NO_X$ is greatly produced and the non-combusted components, such as hydrocarbons which are activated intermediate products responsible for denitration reaction, $NH_3$, HCN and CO, are produced in large amounts and exist for a prolonged period of time in non-combusted condition. Thus, these non-combusted components react with $NO_X$ to $N_2$. Char which is produced in large amounts as a non-combusted component of the primary flame is combusted in the secondary flame. The residual volatile component is combusted mainly by the secondary air ejected through the inner annular outlets to form a secondary flame. Most of the char is combusted by the secondary air and the tertiary air to form a tertiary flame range. The secondary flame and the tertiary flame are formed by the combustion of relatively low speed and low temperature with low $O_2$, because the secondary and tertiary air is about 55–80% in amount of the air necessary for the combustion of all the pulverized coal and the air contains exhaust gas in 35–60%.

Another example of such a low $NO_X$ burner is that which forms the subject matter of U.S. Pat. No. 4,545,307 entitled "Apparatus For Coal Combustion," which issued on Oct. 8, 1985 and which on its face is assigned to Babcock-Hitachi Kabushiki Kaisha of Tokyo, Japan. In accordance with the teachings of U.S. Pat. No. 4,545,307, a low $NO_X$ burner is provided that includes a pulverized coal pipe inserted into a burner throat on the lateral wall of a combustion furnace and for feeding the coal and air into the furnace, a means for feeding the coal and air into the coal pipe, a secondary air passageway formed between the coal pipe and a secondary air-feeding pipe provided on the outer peripheral side of the coal pipe, a tertiary air passageway formed on the outer peripheral side of the secondary air-feeding pipe, a means for feeding air or an oxygen-containing gas into the secondary air passageway and into the tertiary air passageway, and a bluff body having a cross-section of a L- letter form provided at the tip of the coal pipe.

Still another example of such a low $NO_X$ burner is that which forms the subject matter of U.S. Pat. No. 4,539,918 entitled "Multiannular Swirl Combustor Providing Particulate Separation," which issued on Sep. 10, 1985 and which on its face is assigned to Westinghouse Electric Corp. In accordance with the teachings of U.S. Pat. No. 4,539,918, a low $NO_X$ burner is provided that includes a plurality of tubular members having differing axial lengths and disposed to form a burner basket of sufficient size and axial length to contain axially spaced rich and lean combustion zones, means for supporting the tubular members substantially coaxially and telescopically relative to each other to provide a generally annular path for inlet pressurized gaseous reactant or pressurized air flowing into the low $NO_X$ burner with predetermined axial velocity between each tubular member and the next radially outwardly disposed tubular member, means for imparting a tangential velocity to gaseous reactant entering the low $NO_X$ burner through each annular flow path with the tangential velocity of at least the flows entering the rich combustion zone increasing with increasing flow radius, nozzle means for supplying fuel to the low $NO_X$ burner in at least one predetermined location, the tubular members having respective axial lengths and being so disposed that the axial location of the tubular member outlet ends generally have increasing radii and respectively are located at successive downstream locations, the tangential velocity imparting means and the radial and axial geometry of at least two of the tubular members being coordinated under operating inlet gas pressure and gas axial velocity conditions to a) define the rich combustion zone in an upstream portion of the low $NO_X$ burner where high temperature oxygen deficient combustion occurs with flame stabilizing recirculation flow and substantially without net $NO_X$ formation and b) produce a toroidal vortex in the rich combustion zone with recirculating combustion air being recuperatively supplied substantially by the swirling inlet annular air flow after it has cooled the inner wall surfaces of the tubular members about the rich combustion zone and c) provide sufficient fuel particulate residence time in the rich combustion zone to permit particulate burning prior to centrifugal separation of particulates toward the low $NO_X$ burner wall surface, the tangential velocity imparting means and the radial and axial geometry of at least two of the tubular members located outwardly from the tubular members about the rich combustion zone being coordinated under operating inlet gas pressure and gas axial velocity conditions to define the lean combustion zone and to produce a toroidal vortex in the lean combustion zone, the tubular members being arranged to provide a throat section into which the rich combustion zone converges and from which the lean combustion zone diverges, and means for collecting and withdrawing from the combustion particulates separated from the flow as it passes through the throat section.

Yet another example of such a low $NO_X$ burner is that which forms the subject matter of U.S. Pat. No. 4,845,940 entitled "Low $NO_X$ Rich-Lean Combustor Especially Useful In Gas Turbines," which issued on Jul. 11, 1989 and which on its face is assigned to Westinghouse Electric Corp. In accordance with the teachings of U.S. Pat. No. 4,845,940, a low $NO_X$ burner is provided that includes tubular wall means having at least three successive tubular wall portions disposed in successive downstream locations and having respectively increasing dimensions in the radial direction to provide a generally outwardly diverging combustor envelope along the axial direction that defines an outwardly diverging combustion zone for low $NO_X$ combustion, means for supporting the tubular wall portions relative to each other to provide a rigid structure for the low $NO_X$ burner, nozzle means for supplying fuel to the low $NO_X$ burner in at least one predetermined location, each successive pair of adjacent tubular wall portions being structured to define a generally annular inlet flow path extending in the radial direction between the outer surface of the radially inward upstream wall portion of the pair and the inner surface of the radially outward downstream wall portion of the pair and further extending downstream in the axial direction along the inner surface of the radially outward downstream wall portion of the pair so that successive annular flow paths axially overlap to enable the annular flows to combine at least partly for swirling radially inward flow into the combustion zone, the wall portions further being sized and structurally coordinated so that the total annular air flow includes substantially all of the pressurized inlet air flow needed for complete fuel burning in the combustion zone other than any nozzle atomizing air flow or other special air flow that may be provided and such that the combustion air flows inwardly at a rate needed to support rich combustion along the axial region of the combustion zone thereby enabling leaner combustion radially outwardly and axially downstream thereof within the combustion zone, first swirl means for imparting a tangential velocity to inlet air flow through the first and radially inmost annular flow path, second swirl means for imparting a tangential velocity to inlet air flow through the second annular flow path located radially outwardly and axially downstream from the first annular flow path, the first and second swirl means being interrelated to produce a negative radial gradient in the tangential velocities of the inlet air flows through the first and second annular paths, and the tangential velocities decreasing with increasing radius and being operative within the diverging envelope of the combustion zone under operating inlet air pressure and gas axial velocity conditions to produce a depression of the axial velocity on the combustor axis with substantially all of the combustion air being recuperatively supplied by the swirling annular inlet flows after cooling the inner surfaces of the wall portions defining the combustion zone.

Yet a further example of such a low $NO_X$ burner is that which forms the subject matter of U.S. Pat. No. 5,411,394 entitled "Combustion System For Reduction Of Nitrogen Oxides," which issued on May 2, 1995 and which on its face is assigned to Massachusetts Institute of Technology. In accordance with the teachings of U.S. Pat. No. 5,411,394, a low $NO_X$ burner for the combustion of gaseous, liquid and solid fuels is provided, which is characterized by the fact that the fluid dynamic principle of radial stratification by the combustion of swirling flow and a strong radial gradient of the gas density in the transverse direction to the axis of flow rotation is used to damp turbulence near the burner and hence to increase the residence time of the fuel-rich pyrolyzing mixture before mixing with the rest of the combustion air to effect complete combustion.

Notwithstanding the fact that over the years there have been different approaches pursued in the prior art insofar as concerns addressing the need to limit emissions of the $NO_X$ that is created as a consequence of the combustion of fossil fuels in furnaces, a need still exists in the prior art to improve upon what has been accomplished to date in the pursuance of these different approaches. More specifically, low $NO_X$ firing systems constructed in accordance with the teachings of the three issued U.S. patents relating to low $NO_X$ firing systems to which reference has been made hereinbefore have been demonstrated to be operative for the purpose for which they have been designed. Similarly, low $NO_X$ burners constructed in accordance with the teachings of the five issued U.S. patents relating to low $NO_X$ burners to which reference has been made hereinbefore have been demonstrated to be operative for the purpose for which they have been designed.

In particular, although low $NO_X$ burners of the type that forms the subject matter of U.S. Pat. No. 5,411,394, i.e., so-called radially stratified flame core burners, have been demonstrated to be operative for the purpose for which they have been designed, there has nevertheless existed a need for further improvements to be made relating to such radially stratified flame core burners. More specifically, there has been evidenced in the prior art a need to be able to effect control over a radially stratified flame core burner. To this end, furnaces in which the combustion of fossil fuels takes place do not all embody the same depth. Thus, although radial stratification can be accomplished so long as the furnace in which the radially stratified flame core burner is being employed embodies a predetermined depth, if the furnace in which it is desired to employ a radially stratified flame core burner, however, embodies a depth other than the aforereferenced predetermined depth, then there exists a need to be able to effect control over the radially stratified flame core burner such that the reduction in $NO_X$ emissions sought to be attained through the use of the radially stratified flame core burner can nevertheless still be realized therewith.

To thus summarize, a need has been evidenced in the prior art for a new and improved method for effecting control over a radially stratified flame core burner such that regardless of the depth that a furnace may embody the radially stratified flame core burner will still be effective in enabling the reduction in $NO_X$ emissions, which is sought to be attained therewith, to be realized. Moreover, not only should it be possible when employing such a new and improved method for effecting control over a radially stratified flame core burner to achieve such a reduction in $NO_X$ emissions regardless of the depth that the furnace embodies, but such a reduction in $NO_X$ emissions should also be attainable while yet at the same time the following benefits, which serve to characterize a radially stratified flame core burner, are still capable of being derived through the use of the radially stratified flame core burner. One such benefit is that a radially stratified flame core burner, which is being controlled by means of such a new and improved method for effecting control over a radially stratified flame core burner, is still capable, without the use of overfire air or flue gas recirculation, of reducing $NO_X$ emissions to a level that enables state and federal $NO_X$ limits to be met. A second such benefit is that a radially stratified flame core burner, which is being controlled by means of such a new and improved method for effecting control over a radially stratified flame core burner, is capable of achieving $NO_X$ values of less than 0.25 lb./MM BTU while firing No. 6 fuel oil. A third such benefit is that a radially stratified flame core burner, which is being controlled by means of such a new and improved method for effecting control over a radially stratified flame core burner, embodies the capability therewith of adjusting the angular momentum thereof and of biasing the airflow thereof. A fourth such benefit is that a radially stratified flame core burner, which is being controlled by means of such a new and improved method for effecting control over a radially stratified flame core burner, is characterized by the fact that the operating mechanisms thereof are so positioned as to be protected from heat being radiated from the furnace. A fifth such benefit is that a radially stratified flame core burner, which is being controlled by means of such a new and improved method for effecting control over a radially stratified flame core burner, possesses multi-fuel capabilities, i.e., oil, natural gas and coal. A sixth such benefit is that a radially stratified flame core burner, which is controlled by means of such a new and improved method for effecting control over a radially stratified flame core burner, is capable of being integrated into virtually any new or existing combustion firing system. A seventh such benefit is that a radially stratified flame core burner, which is controlled by means of such a new and improved method for effecting control over a radially stratified flame core burner, is capable of being retrofitted to virtually any boiler design. An eighth such benefit is that a radially stratified flame core burner, which is being controlled by means of such a new and improved method for effecting control over a radially stratified flame core burner, possesses a burner heat input rating from 1 MM BTU per hour. A ninth such benefit is that a radially stratified flame core burner, which is being controlled by means of such a new and improved method for effecting control over a radially stratified flame core burner, that permits high-grade materials to be selected for use therein in order to thereby address therewith heat and/or corrosion issues.

It is, therefore, an object of the present invention to provide a new and improved method for effecting control over a radially stratified flame core burner.

It is a further object of the present invention to provide such a new and improved method for effecting control over a radially stratified flame core burner such that regardless of the depth that a furnace may embody the radially stratified flame core burner will still be effective in enabling the reduction in $NO_X$ emissions, which is sought to be attained therewith, to be realized.

It is another object of the present invention to provide such a new and improved method for effecting control over a radially stratified flame core burner wherein the radially stratified core burner is still capable, without the use of overfire air or flue gas recirculation, of reducing $NO_X$ emissions to a level that enables state and federal $NO_X$ limits to be met.

It is still another object of the present invention to provide such a new and improved method for effecting control over a radially stratified flame core burner wherein the radially stratified flame core burner is capable of achieving $NO_X$ values of less than 0.25 lb./MM BTU while firing No. 6 fuel oil.

Another object of the present invention is to provide such a new and improved method for effecting control over a radially stratified flame core burner that embodies the capability of adjusting therewith the angular momentum thereof and of biasing therewith the airflow thereof.

A still another object of the present invention is to provide such a new and improved method for effecting control over a radially stratified flame core burner wherein the radially stratified flame core burner is characterized by the fact that the operating mechanisms thereof are so positioned as to be protected from heat being radiated from the furnace.

A further object of the present invention is to provide such a new and improved method for effecting control over a radially stratified flame core burner wherein the radially stratified flame core burner possesses multi-fuel capabilities, i.e., oil, natural gas and coal.

A still further object of the present invention is to provide such a new and improved method for effecting control over a radially stratified flame core burner wherein the radially stratified flame core burner is capable of being integrated into virtually any new or existing combustion firing system.

Yet an object of the present invention is to provide such a new and improved method for effecting control over a radially stratified flame core burner wherein the radially stratified flame core burner is capable of being retrofitted to virtually any boiler design.

Yet a further object of the present invention is to provide such a new and improved method for effecting control over a radially stratified flame core burner wherein the radially stratified flame core burner possesses a burner heat input rating from 1 MM BTU per hour.

Yet another object of the present invention is to provide such a new and improved method for effecting control over a radially stratified flame core burner wherein the radially stratified flame core burner permits high-grade materials to be selected for use therein in order to thereby address therewith heat and/or corrosion issues.

SUMMARY OF THE PRESENT INVENTION

In accordance with the present invention there is provided a method for effecting control over a radially stratified flame core burner that is particularly suited for employment in a firing system of a fossil fuel-fired furnace for purposes of reducing the $NO_X$ emissions from the fossil fuel-fired furnace. Moreover, the subject method for effecting control over a radially stratified flame core burner enables the foregoing to be accomplished while yet at the same time minimizing CO emissions and the opacity of the exhaust from the stack of the fossil fuel-fired furnace without extending the envelope of the flame produced by the radially stratified flame core burner. The subject method for effecting control over a radially stratified flame core burner wherein the radially stratified flame core burner is to be installed in a fossil fuel-fired furnace and when so installed therein is operative for purposes of reducing the $NO_X$ emissions from the fossil fuel-fired furnace comprises the steps of: determining the depth of the furnace in which the radially stratified flame core burner is to be installed, establishing the permissible length of the flame that the radially stratified flame core burner is capable of producing as a function of the depth of the fossil fuel-fired flame core burner in which the radially stratified furnace is to be installed, establishing an outer zone of air flow coaxial with but spaced from the centerline of the radially stratified flame core burner as a consequence of the injection thereinto of 60% to 80% of the total air required to effect the combustion of the fossil fuel being burned through operation of the radially stratified flame core burner, establishing an inner zone of air flow and fossil fuel flow coaxial with the centerline of the radially stratified flame core burner as a consequence of the injection thereinto of the remainder of the total air required to effect the combustion of the fossil fuel being burned through operation of the radially stratified flame core burner and as a consequence of the injection thereinto of the fossil fuel being burned through operation of the radially stratified flame core burner, and effecting control over the length of the flame produced by the radially stratified flame core burner by controlling the angular momentum of the air injected into the inner zone and by controlling the angle of injection of the fossil fuel injected into the inner zone so that the length of the flame produced by the radially stratified flame core burner is no greater than the permissible length of the flame that has been established for the fossil fuel-fired furnace in which the radially stratified flame core burner is to be installed.

DESCRIPTION OF THE PREFERRED EMBODIMENT

Figure 1:
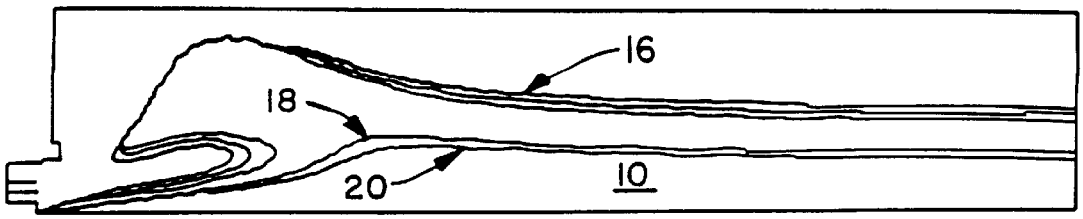
FIG. 1 is a schematic illustration of a first flame type that is capable of being produced with the method for effecting control over a radially stratified flame core burner of the present invention.
Figure 2:
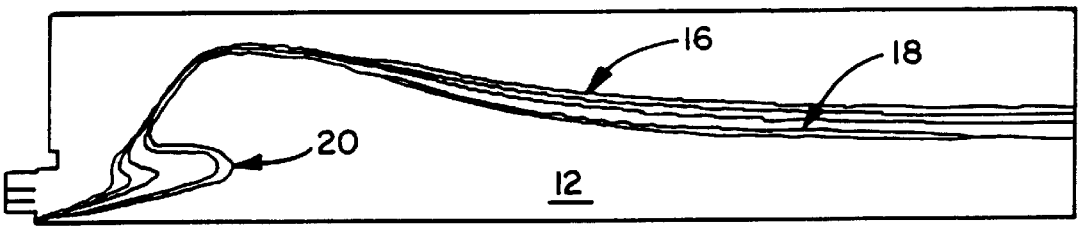
FIG. 2 is a schematic illustration of a second flame type that is capable of being produced with the method for effecting control over a radially stratified flame core burner of the present invention.
Figure 3:
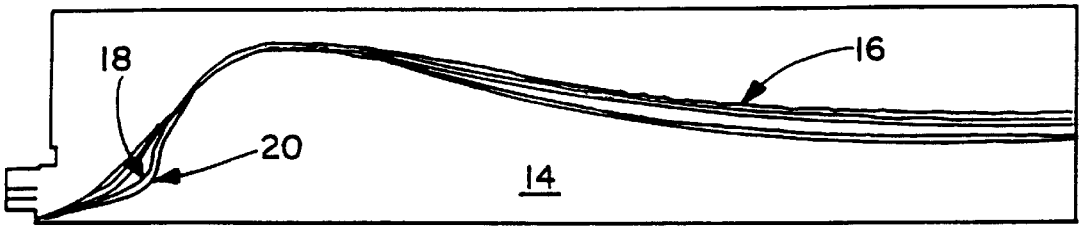
FIG. 3 is a schematic illustration of a third flame type that is capable of being produced with the method for effecting control over a radially stratified flame core burner of the present invention.

Referring now to the drawing, and more particularly to FIGS. 1, 2 and 3 thereof, there are schematically illustrated therein various flame types that are capable of being produced with the method for effecting control over a radially stratified flame core burner in accordance with the present invention. Namely, in FIG. 1 of the drawing there is schematically illustrated a first flame type, denoted generally therein by the reference numeral 10. In FIG. 2 of the drawing there is schematically illustrated a second flame type, denoted generally therein by the reference numeral 12. In FIG. 3 of the drawing there is schematically illustrated a third flame type, denoted generally therein by the reference numeral 14. For purposes of facilitating a better understanding of the flame types that are schematically illustrated in each of FIGS. 1, 2 and 3 of the drawing, the air, which as will be described more fully hereinafter is injected into the outer zone to which further reference will also be had hereinafter, is denoted generally in each of FIGS. 1, 2 and 3 by the same reference numeral, i.e., reference numeral 16. Likewise, the remainder of the air, which as will be described more fully hereinafter is injected into the inner zone to which further reference will also be had hereinafter, is denoted generally in each of FIGS. 1, 2 and 3 by the same reference numeral, i.e., reference numeral 18. Finally, the fossil fuel, which as will be described more fully hereinafter is injected into the inner zone to which further reference will be had hereinafter, is denoted generally in each of FIGS. 1, 2 and 3 by the same reference numeral, i.e., reference numeral 20.

Figure 4:
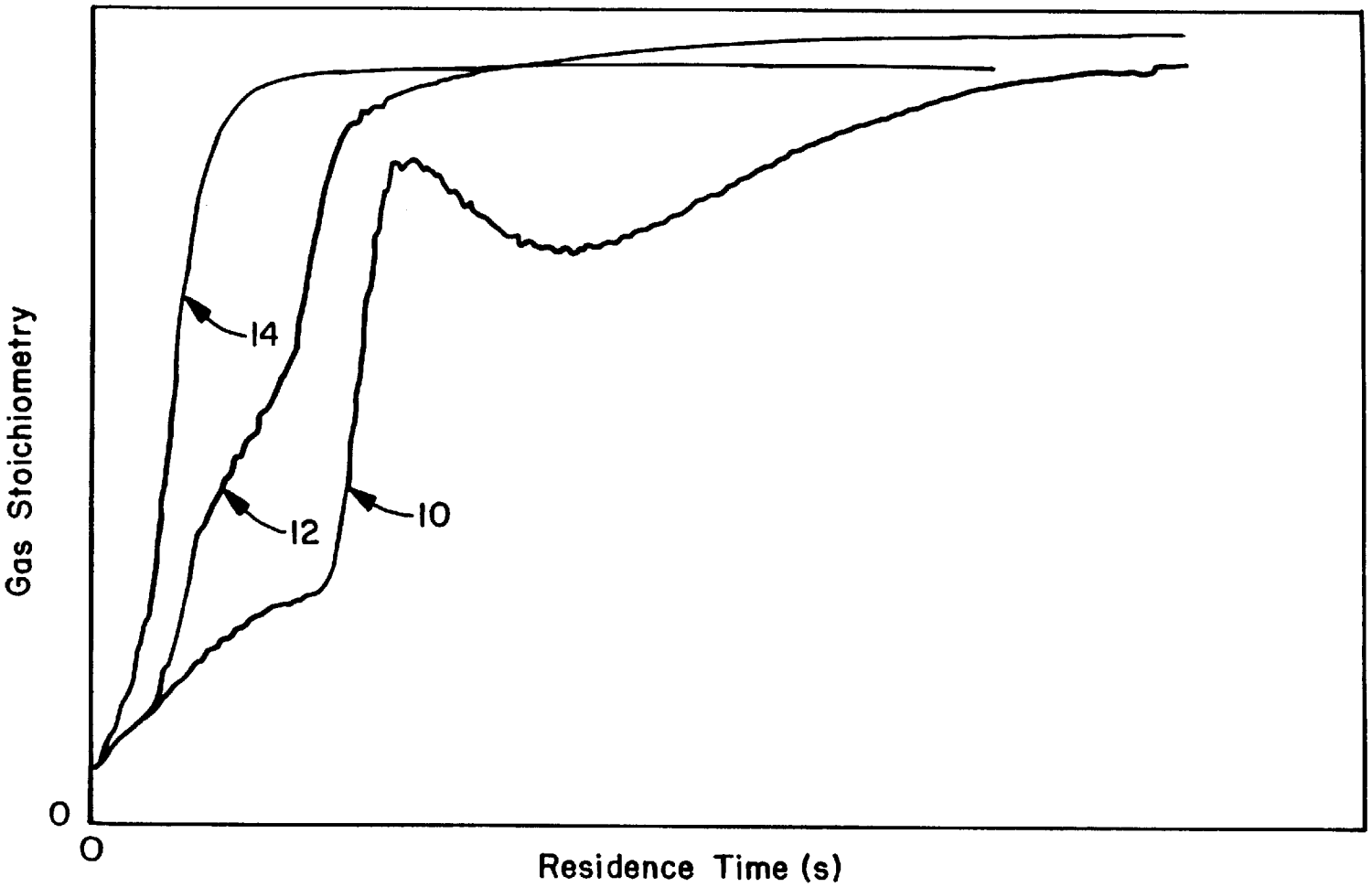
FIG. 4 is a graphical plot of gas stoichiometry versus residence time for each of the flame types that are illustrated in FIGS. 1, 2 and 3, respectively.

Continuing, reference will next be had herein to FIG. 4 of the drawing, which is a graphical plot of the gas stoichiometry versus residence time associated with each of the flame types that are schematically illustrated in FIGS. 1, 2 and 3 of the drawing. For purposes of the discussion thereof herein, a flame type is deemed to have a short flame length or a long flame length or a medium flame length based on the amount of residence time that it takes for a leveling off of the gas stoichiometry to occur. Namely, the quicker that a leveling off of the gas stoichiometry occurs the shorter the flame length. Thus, in accordance with the foregoing, as best understood with reference to FIG. 4 wherein each of the flame types that are schematically illustrated in each of FIGS. 1, 2 and 3 are depicted, the flame type 14 will be deemed herein to be representative of a flame type that possesses a short flame length as compared to the flame length possessed by the flame types 10 and 12. Likewise, the flame type 10 will be deemed herein to be representative of a flame type that possesses a long flame length as compared to the flame length possessed by the flame types 12 and 14, while the flame type 12 will be deemed herein to be representative of a flame type that possesses a medium flame length as compared to the flame length possessed by the flame types 10 and 14.

Insofar as low $NO_X$ burners are concerned, it has been found that internal air staging requires the formation of a fuel-rich, high temperature pyrolysis zone near the outlet of the low $NO_X$ burner followed thereafter by a lean flame region in which the pyrolysis combustible products burn out by mixing with the residual combustion air. As regards radially stratified flame core burners in particular, radial stratification extends the residence time within the fuel-rich, high temperature pyrolysis zone and thereby has the effect of increasing the conversion of the total bound nitrogen to $N_2$. Moreover, it has been recognized that early ignition and rapid temperature rise within the fuel-rich, high temperature pyrolysis zone are important for achieving low emissions of $NO_X$.

Relating the foregoing to the flame types 10, 12 and 14 that are schematically illustrated in FIGS. 1, 2 and 3 of the drawing, a flame type possessing a very short flame length such as the flame type 14 embodies the following characteristics. A flame type such as the flame type 14 consists of a very short, well stirred flame with high volumetric heat release. In addition, a flame type such as the flame type 14 possesses a very high degree of turbulent flow insofar as the air being injected into the inner zone to which further reference will be had hereinafter, and a single strong internal recirculation zone within the aforereferenced inner zone with no penetration of this single strong internal recirculation zone by the air being injected into the aforementioned inner zone nor by the fossil fuel being injected into the aforementioned inner zone. Ninety-nine percent burnout of the fossil fuel being injected into the aforementioned inner zone is capable of being realized with the flame type 14. Of the three flame types, i.e., flame types 10, 12 and 14, flame type 14 has the highest level of $NO_X$ emissions because the fuel-rich, high temperature pyrolysis zone is very small, i.e., has the least residence time, and thus by virtue of its being very small limits the destruction of fuel N. However, the flame type 14 is still capable of enabling $NO_X$ emissions to be reduced to a level that enables state and federal $NO_X$ limits to be met.

On the other hand, a flame type such as the flame type 10 that possesses a long flame length is characterized by the following. Namely, a flame type such as the flame type 10 possesses a lesser degree of turbulent flow insofar as the air being injected into the aforereferenced inner zone is concerned than does the flame type 14. Moreover, a flame type such as the flame type 10 that has a long flame length is further characterized in that it embodies two internal recirculation zones. One of these two internal recirculation zones, i.e., the first internal recirculation zone, is located on the axis of the flame that is produced by the radially stratified flame core burner and is a creation of the air that is injected into the aforementioned inner zone. Furthermore, this first internal recirculation zone is fully penetrated by the fossil fuel that is injected into the aforementioned inner zone. The other internal recirculation zone, i.e., the second recirculation zone, is located downstream of the first internal recirculation zone and is radially displaced from the axis of the flame that is produced by the radially stratified flame core burner. The second internal recirculation zone is a creation of the air that is injected into the outer zone to which further mention will be made hereinafter. Due to the full penetration of the first internal recirculation zone by the fossil fuel that is injected into the aforementioned inner zone, flame type 10 produces a low NO, but high CO and high opacity flame.

Consideration will next be given herein to a flame type such as the flame type 12 that possesses a medium flame length. A flame type such as the flame type 12 that possesses a medium flame length is also characterized by the fact that it possesses a degree of turbulent flow insofar as the air injected into the aforereferenced inner zone is concerned similar to that possessed by the flame type 10 and a lesser degree of turbulent flow than that possessed by the flame type 14. In addition, a flame type such as the flame type 12 is characterized by the fact that like the flame type 10 it also embodies two internal recirculation zones, i.e., a first internal recirculation zone and a second internal recirculation zone. The first internal recirculation zone and the second internal recirculation zone of the flame type 12 are positioned relative to one another and relative to the axis of the flame produced by the radially stratified flame core burner as are the first internal recirculation zone and the second internal recirculation zone of the flame type 10 and are created in the same manner as are the first internal recirculation zone and the second internal recirculation zone of the flame type 10. However, unlike in the case of the flame type 10, which has been the subject of discussion previously herein, the air that is injected into the aforementioned inner zone as well as the fossil fuel that is injected into the aforementioned inner zone only partially penetrate the second internal recirculation zone before the air and the fossil fuel are diverted to flow along the outer boundary of the second internal recirculation zone. Whereas the flame type 14 as described hereinbefore is characterized by the fact that $NO_X$ emissions are reduced the least therewith insofar as flame types 10, 12 and 14 are concerned, and whereas the flame type 10 as described hereinbefore is characterized by the fact that it produces a low NO but high CO and high opacity flame, the flame type 12 achieves the optimum, i.e., low $NO_X$, low CO and low opacity.

Figure 5:
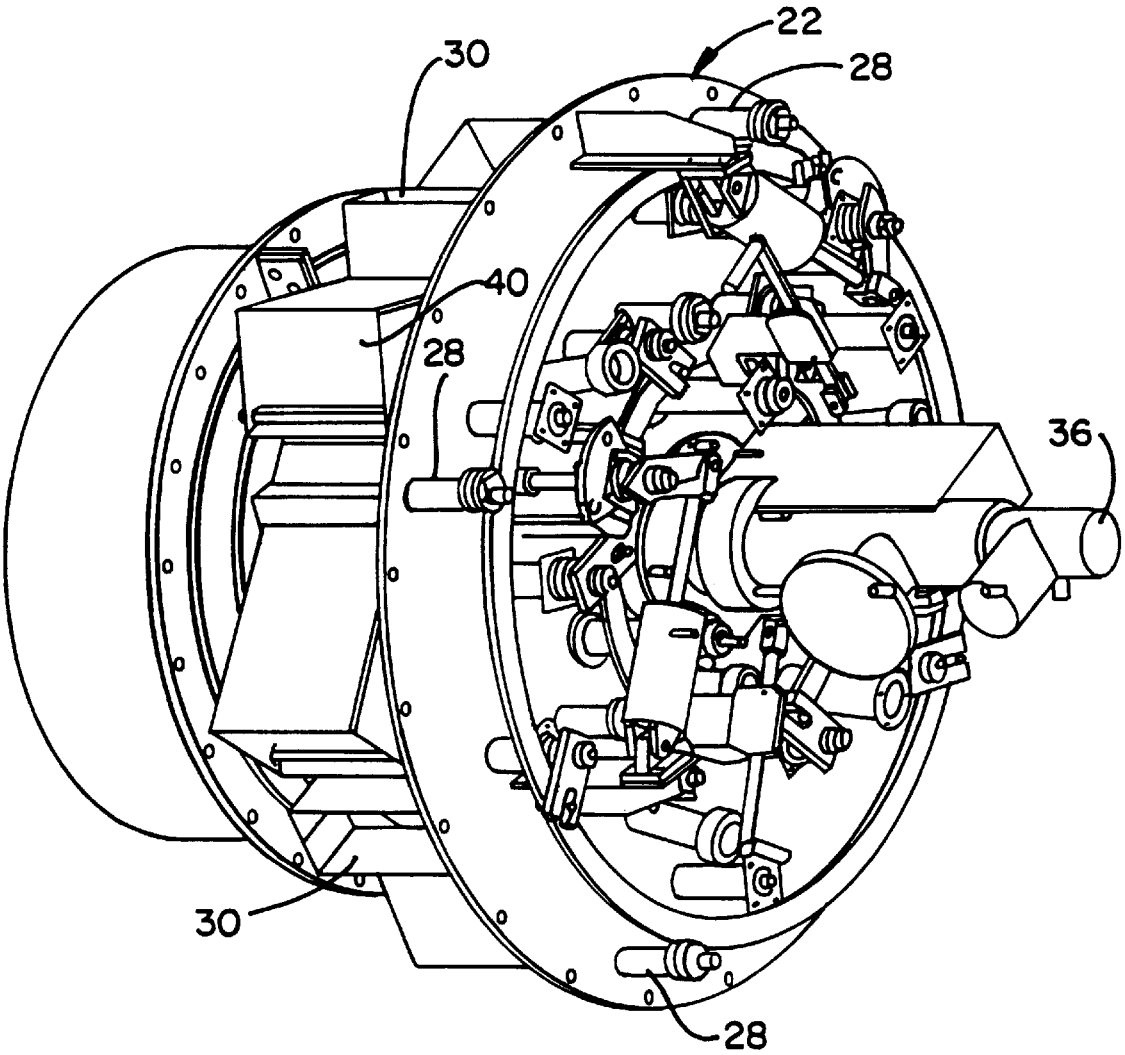
FIG. 5 is a perspective view of a first embodiment of a radially stratified flame core burner that is capable of being controlled by means of the method for effecting control over a radially stratified flame core burner of the present invention.
Figure 6:
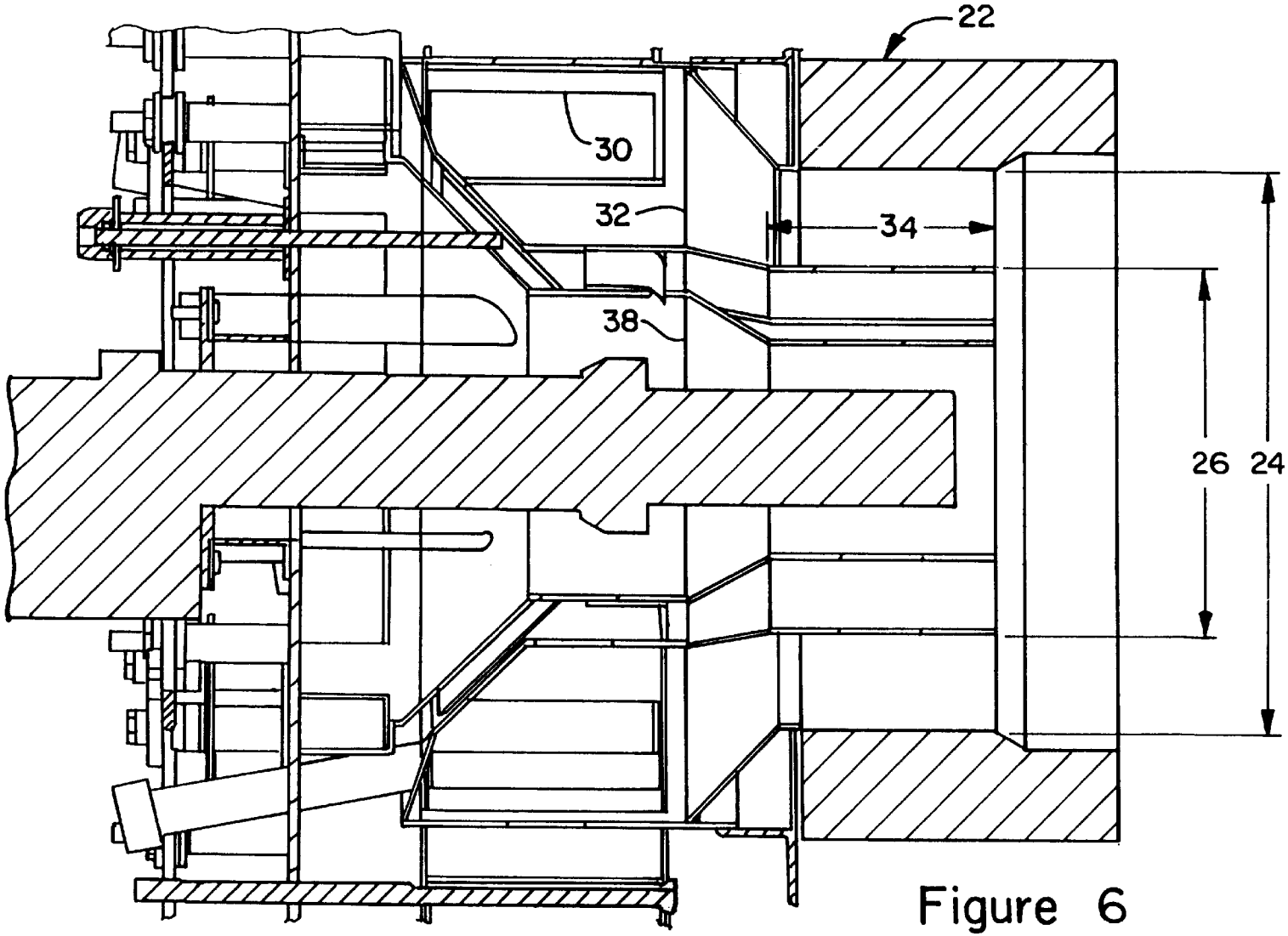
FIG. 6 is a side elevational view partially in section of the first embodiment of a radially stratified flame core burner that is illustrated in FIG. 5.

Reference will next be had to FIGS. 5 and 6 of the drawing for purposes of setting forth herein a description of the outer zone and the inner zone to which considerable mention has been made hereinbefore. For this purpose, only those components of a radially stratified flame core burner, such as the radially stratified flame core burner that is denoted generally by the reference numeral 22 in FIGS. 5 and 6 of the drawing will be described in detail herein. Reference may be had to the prior art for a description of the other components of a radially stratified flame core burner that are not described in detail herein.

Continuing, as best understood with reference to FIG. 6 of the drawing, the outer zone to which considerable mention has been made hereinbefore comprises the area whose diameter is denoted by the reference numeral 24. On the other hand, the inner zone to which considerable mention has been made hereinbefore comprises the area whose diameter is denoted in FIG. 6 by the reference numeral 26.

A description will next be had herein of the flow path internal of the radially stratified flame core burner 22 through which the air flows before being injected into the outer zone 24, and of the flow paths internal of the radially stratified flame core burner 22 through which the air and fossil fuel flow before being injected into the inner zone 26. For this purpose reference will once again be had to both FIGS. 5 and 6 of the drawing. As best understood with reference to FIG. 5 of the drawing, the radially stratified flame core burner 22 is designed to be mounted in supported relation at a preestablished location in a wall of a fossil fuel-fired furnace (not shown). To this end, the wall of the fossil fuel-fired furnace (not shown) is provided for this purpose with a suitable opening. In accordance with the embodiment of the radially stratified flame core burner 22 illustrated in FIG. 5 of the drawing, such mounting of the radially stratified flame core burner 22 in supported relation in the aforesaid opening in the wall of the fossil fuel-fired furnace (not shown) may be accomplished by means of the mounting means denoted in FIG. 5 by the reference numeral 28. When so mounted in the wall of the fossil fuel-fired furnace (not shown), the portion, identified in FIG. 5 by the reference numeral 30, of the radially stratified flame core burner 22 projects into the opening provided for this purpose in the wall of the fossil fuel-fired furnace (not shown).

Continuing, the air that flows through the radially stratified flame core burner 22 before being injected into the outer zone 24 enters the radially stratified flame core burner 22 through a plurality of inlet openings, denoted in FIG. 5 by the reference 30. In the interest of maintaining clarity of illustration in the drawing, only two of such plurality of inlet openings 30 are visible in FIG. 5. After entering the radially stratified flame core burner 22 through the plurality of inlet openings 30 with which the radially stratified flame core burner 22 is provided for this purpose, the air, as best understood with reference to FIG. 6 of the drawing, flows through means, denoted by the reference numeral 32 in FIG. 6, suitable for use for purposes of imparting a predetermined angular momentum to the air before the air is injected into the outer zone 24. As seen with reference to FIG. 6 of the drawing, the means 30 is suitably located a predetermined distance within the interior of the radially stratified flame core burner 22. For ease of understanding, this predetermined distance is denoted in FIG. 6 by the arrows that are identified in FIG. 6 through the use of the reference numeral 34. By virtue of being so located within the interior of the radially stratified flame core burner 22, the means 32 is not susceptible to being exposed to the heat being radiated from the fossil fuel-fired furnace (not shown).

Next a description will be had of the flow paths through the radially stratified flame core burner 22 of the air and the fossil fuel that are injected into the inner zone 26. For this purpose, reference will once again be had to FIGS. 5 and 6 of the drawing. To this end, the fossil fuel, as best understood with reference to FIG. 5 of the drawing, enters the radially stratified flame core burner 22 through fuel inlet opening, denoted in FIG. 5 by the reference numeral 36. After entering the radially stratified flame core burner 22 through the fuel inlet opening 36, the fossil fuel flows essentially along the centerline of the radially stratified flame core burner 22 before being injected into the inner zone 26. On the other hand, the air that is injected into the inner zone 26 flows in surrounding relation to the flow path that the fossil fuel follows in flowing through the radially stratified flame core burner 22. To this end, after entering the radially stratified flame core burner 22 through suitable inlet openings with which the radially stratified flame core burner 22 is provided for this purpose, the air flows through means, identified in FIG. 6 of the drawing by the reference numeral 38, suitable for use for the purpose of imparting an angular momentum to the air before the air is injected into the inner zone 26. As set forth herein previously, approximately 60% to 80% of the total air required for the combustion of the fossil fuel that is injected into the inner zone 26 is injected into the outer zone 24 whereas the remainder of the total air required for the combustion of the fossil fuel that is injected into the inner air 26 is injected along with the fossil fuel into the inner zone 26. Further, as has also been set forth herein previously, in accordance with the present invention by controlling the angular momentum of the air that is injected into the inner zone 26 and by controlling the angle of injection at which the fossil fuel is injected into the inner zone 26, it is possible to effect control over, i.e., to cause the flame being produced by the radially stratified flame core burner 22 as a consequence of the combustion of the fossil fuel that is injected into the inner zone 26, to have a predetermined length wherein the predetermined flame length is established as a function of the depth of the fossil fuel-fired furnace in which the radially stratified flame core burner 22 is to be installed.

Figure 7:
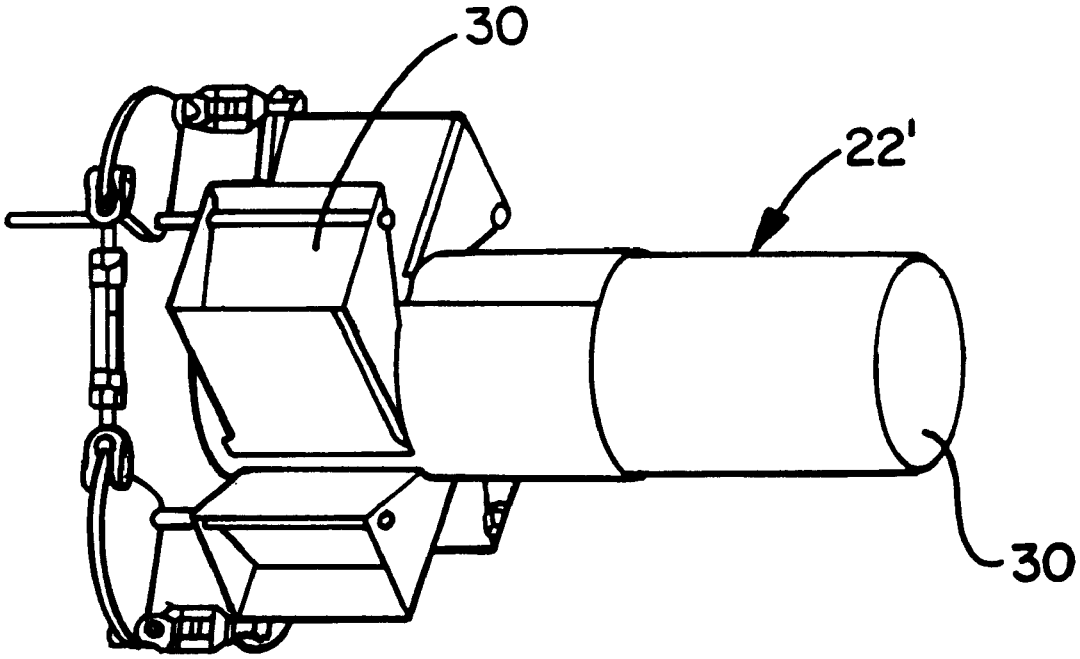
FIG. 7 is a side elevational view of a second embodiment of a radially stratified flame core burner that is capable of being controlled by means of the method for effecting control over a radially stratified flame core burner of the present invention.

Reference will next be had to FIG. 7 of the drawing wherein there is illustrated a second embodiment of a radially stratified flame core burner, denoted generally therein by the reference numeral 22', with which the method for effecting control over a radially stratified flame core burner of the present invention may be utilized. The only major difference between the nature of the construction of the radially stratified flame core burner 22 that is illustrated in FIGS. 5 and 6 of the drawing and the radially stratified flame core burner 22' that is illustrated in FIG. 7 of the drawing resides in the nature of the construction of the inlet openings through which the air that is injected into the outer zone 24 enters the radially stratified flame core burners 22 and 22'. To this end, in the case of the radially stratified flame core burner 22 a transition piece, denoted by the reference numeral 40 in FIG. 5 of the drawing, is interposed between the inlet opening 30 and the interior of the radially stratified flame core burner 22. On the other hand, in the case of the radially stratified flame core burner 22' the transition piece 40 associated with each of the inlet openings 30 in the case of the radially stratified flame core burner 22 have been eliminated such that in the case of the radially stratified flame core burner 22' the air that is injected into the outer zone 26 after entering the radially stratified flame core burner 22' through the inlet openings 30 flows directly therefrom into the interior of the radially stratified flame core burner 22'.

Thus, in accordance with the present invention there is provided a new and improved method for effecting control over a radially stratified flame core burner. As well, there is provided in accord with the present invention such a new and improved method for effecting control over a radially stratified flame core burner such that regardless of the depth that a furnace may embody the radially stratified flame core burner will still be effective in enabling the reduction in $NO_X$ emissions, which is sought to be attained therewith, to be realized. Moreover, in accord with the present invention there is provided such a new and improved method for effecting control over a radially stratified flame core burner wherein the radially stratified flame core burner is still capable, without the use of overfire air or flue gas recirculation, of reducing $NO_X$ emissions to a level that enables state and federal $NO_X$ limits to be met. Also, there is provided in accord with the present invention such a new and improved method for effecting control over a radially stratified flame core burner wherein the radically stratified flame core burner is capable of achieving $NO_X$ values of less than 0.25 lb./MM BTU while firing No. 6 fuel oil. Further, in accordance with the present invention there is provided such a new and improved method for effecting control over a radially stratified flame core burner that embodies the capability of adjusting therewith the angular momentum thereof and of biasing therewith the airflow thereof. Besides, there is provided in accord with the present invention such a new and improved method for effecting control over a radially stratified flame core burner that is characterized by the fact that the operating mechanisms thereof are so positioned as to be protected from heat being radiated from the furnace. In addition, there is provided in accord with the present invention such a new and improved method for effecting control over a radially stratified flame core burner wherein the radially stratified flame core burner possesses multi-fuel capabilities, i.e., oil, natural gas and coal. Furthermore, in accordance with the present invention there is provided such a new and improved method for effecting control over a radially stratified flame core burner wherein the radially stratified flame core burner is capable of being integrated into virtually any new or existing combustion firing system. Additionally, there is provided in accord with the present invention such a new and improved method for effecting control over a radially stratified flame core burner wherein the radially stratified flame core burner is capable of being retrofitted to virtually any boiler design. Penultimately, in accordance with the present invention there is provided such a new and improved method for effecting control over a radially stratified flame core burner wherein the radially stratified flame core burner possesses a burner heat input rating from 1 MM BTU per hour. Finally, there is provided in accord with the present invention such a new and improved method for effecting control over a radially stratified flame core burner wherein the radially stratified flame core burner permits high-grade materials to be selected for use therein in order to thereby address therewith heat and/or corrosion issues.

While an embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. A method for effecting control over a radially stratified flame core burner installed in a fossil fuel-fired furnace comprising the steps of:

a. providing a furnace having a radially stratified flame core burner installed therewith;

b. establishing an outer zone of air flow consequence of the injection thereinto of a first portion of the total amount of required to effect the combustion of the fossil fuel being burned through operation of the radially stratified flame core burner;

c. establishing an inner zone of air flow and a fossil fuel as a consequence of the injection thereinto of a second portion of the total amount of air required to effect the combustion of the fossil fuel being burned through operation of the radially stratified flame core burner;

d. establishing a plurality of different flame types that the radially stratified flame core burner is capable of producing with the same predetermined volume of air injected into the inner zone as the second portion of the total amount of air, the step of establishing the plurality of different flame types including controlling the angular momentum of the air injected into the inner zone by mechanical means which do not vary the predetermined volume of the injected air and controlling the angle of injection of the fossil fuel injected into the inner zone, a first one of the plurality of different flame types being a flame type possessing a very injection of the fossil fuel injected into the inner zone, a first one of the plurality of different flame types being a flame type possessing a very short flame length that is characterized by a very short, well stirred flame with high volumetric heat release and that is operative to produce therewith the highest $NO_X$ level of any of the plurality of different flame types yet a $NO_X$ level that is still capable of meeting State and Federal requirements, a second one of the plurality of different types of flame types being a flame type possessing a medium flame length that is characterized by a medium flame with a moderate degree of turbulent flow and that is operative to produce therewith low $NO_X$, low CO and low opacity, and a third one of the plurality of different flame types being a flame type possessing a long flame length that is characterized by a long flame with a lesser degree of turbulent flow than any other one of the plurality of different flame types and that is operative to produce therewith low $NO_X$, high CO and high opacity;

e. establishing the depth of the furnace having the radially stratified flame core burner installed therewithin as being of a specific depth selected from a plurality of different depths, a first one of the plurality of different depths being a depth that is short in length, a second one of the plurality of different depths being a depth that is medium in length, and a third one of the plurality of different depths being a depth that is long in length; and f. selecting based on the establishment of the depth of the furnace having the radially stratified flame core burner installed therewithin in accordance with e. the one of the plurality of different flame types that has a length corresponding to the depth of the furnace such that if the depth of the furnace is short the flame type selected from the plurality of different flame types is the flame type possessing a very short length and if the depth of the furnace is medium the flame type selected from the plurality of different flame types is the flame type possessing a medium length and if the depth of the furnace is long the flame type selected from the plurality of different flame types is the flame type possessing a long length with the same predetermined volume of air being injected into the inner zone irrespective of the one of the plurality of different flame types which is selected.

2. The method for effecting control over a radially stratified flame core burner as set forth in claim 1 wherein the first portion of the total air injected into the outer zone comprises 60% to 80% of the total amount of air required to effect the combustion of the fossil fuel being burned through operation of the radially stratified flame core burner.

3. The method for effecting control over a radially stratified flame core burner as set forth in claim 2 further comprising the step of imparting an angular momentum to the first portion of the total air injected into the outer zone before the first portion of the total air is injected thereinto.

4. The method for effecting control over a radially stratified flame core burner as set forth in claim 3 wherein the outer zone lies coaxial with but spaced from the centerline of the radially stratified flame core burner.

5. The method for effecting control over a radially stratified flame core burner as set forth in claim 2 wherein the second portion of the total air injected into the inner zone comprises the remainder of the total air required to effect combustion of the fossil fuel being burned through operation of the radially stratified flame core burner.

6. The method for effecting control over a radially stratified flame core burner as set forth in claim 5 wherein the inner zone of air flow and fossil fuel lies along the centerline of the radially stratified flame core burner.

7. The method for effecting control over a radially stratified flame core burner as set forth in claim 6 further comprising the step of imparting an angular momentum to the second portion of the total air being injected into the inner zone before the second portion of the total air is injected thereinto.

8. The method for effecting control over a radially stratified flame core burner as set forth in claim 1 wherein all of the fossil fuel being burned through operation of the radially stratified flame core burner is injected into the inner zone.

9. The method for effecting control over a radially stratified flame core burner as set forth in claim 8 wherein the fossil fuel is injected into the inner zone along the centerline of the radially stratified flame core burner.

10. The method for effecting control over a radially stratified flame core burner as set forth in claim 1 wherein the radially stratified flame core burner possesses a burner heat input rating from 1 MM BTU.

* * * * *